US005380346A

United States Patent [19]

Fritz

[11] Patent Number: 5,380,346

[45] Date of Patent: Jan. 10, 1995

[54] FORTIFIED HYDROCARBON AND PROCESS FOR MAKING AND USING THE SAME

[76] Inventor: James E. Fritz, 271 Crutcher Rd., Port Townsend, Wash. 98368

[21] Appl. No.: 83,826

[22] Filed: Jun. 25, 1993

Related U.S. Application Data

[63] Continuation-in-part of Ser. No. 898,042, Jun. 12, 1992, Pat. No. 5,236,467.

[51] Int. Cl.[6] ..... C10L 1/18

[52] U.S. Cl. ..... 44/401; 44/438; 44/446; 44/448; 48/197 FM

[58] Field of Search ..... 44/401, 438, 446, 448; 48/197 FM

[56] References Cited

U.S. PATENT DOCUMENTS

| | | | |
|---|---|---|---|
| 1,565,935 | 12/1925 | Harris . | |
| 2,221,839 | 11/1940 | Lipkin | 44/448 |
| 2,228,662 | 1/1941 | Holm | 44/401 |
| 2,281,910 | 5/1942 | Bialosky et al. | 148/23 |
| 2,411,759 | 11/1946 | Seley | 44/52 |
| 2,513,769 | 7/1950 | White | 48/197 |
| 2,908,599 | 10/1959 | Medsker | 148/23 |
| 2,951,750 | 9/1960 | White | 48/197 |
| 3,591,355 | 7/1971 | Kessler | 48/197 |
| 3,869,262 | 3/1975 | Mayerhoffer et al. | 44/438 |
| 3,989,479 | 11/1976 | White | 48/197 |
| 5,232,464 | 8/1993 | Klezl | 44/446 |

FOREIGN PATENT DOCUMENTS

| | | | |
|---|---|---|---|
| 689179 | 10/1966 | Belgium . | |
| 697274 | 4/1967 | Belgium . | |
| 2455727 | 8/1974 | Germany | 48/197 FM |
| 0569108 | 5/1945 | United Kingdom | 48/197 FM |
| 813981 | 5/1959 | United Kingdom . | |

*Primary Examiner*—Jacqueline V. Howard
*Attorney, Agent, or Firm*—Robert W. Beach

[57] ABSTRACT

Fortified hydrocarbon torch gas is a mixture of a major portion by weight of hydrocarbon base gas and additive selected from 1,2-ethanediol, 1,2-propanediol, 1,3 butanediol, glycerol, diethylene glycol, ethylene glycol monomethyl ether, ethylene glycol monoethyl ether, ethylene glycol dimethyl ether, ethyl acetate, n-propyl alcohol, isopropyl alcohol, n-butyl alcohol, isobutyl alcohol, sec butyl alcohol, methyl ethyl ketone, propionaldehyde, and butyraldehyde and liquid hydrocarbon fuel fortified with ethylene glycol monomethyl ether or ethyl acetate.

22 Claims, No Drawings

FORTIFIED HYDROCARBON AND PROCESS FOR MAKING AND USING THE SAME

CROSS REFERENCE

This application is a continuation-in-part of my copending patent application Ser. No. 07/898,042, filed Jun. 12, 1992, for Double Fortified Hydrocarbon and Process for Making and Using the Same, issued as U.S. Pat. No. 5,236,467 on Aug. 17, 1993.

BACKGROUND OF THE INVENTION

1. Field of the Invention

The present invention relates to hydrocarbons including gas for use in cutting and/or welding torches, internal-combustion engine fuels and high temperature heating gas and oil fortified by the addition of a double additive or conditioner.

2. Prior Art

Various attempts have been made heretofore to improve gas used in cutting and/or welding torches by adding an additive or a double additive to them. These prior art gases have been composed of various hydrocarbons from methane to octane and some have included propane and butane. Harris U.S. Pat. No. 1,565,935, issued Dec. 15, 1925, for example, fortified a wet casinghead gas composed of methane, ethane, propane, butane and hexane by the addition of ethyl ether [diethyl ether $(C_2H_5)_2O$ or $C_4H_{10}O$] or methyl ether [dimethyl ether $(CH_3)_2O$]. Another patent that proposed to add ethyl ether, also called ethyl oxide, to a gas including propane or butane and propane is White U.S. Pat. No. 2,513,769, issued Jul. 4, 1950.

British patent specification No. 813,981, published May 27, 1959 (Oxy-Ferrolene Limited) proposed to add to hydrocarbon gas an oxygen-containing compound such as isopropyl ether [diisopropyl ether] $[(CH_3)_2CH]_2O$ or $(C_3H_7)_2$ or $C_6H_{14}O$], methyl isopropyl ether, methyl propyl ether $[(CH_3)CH_2CH_2OCH_3$ or $C_4H_{10}O]$, normal propyl ether, ethanol $[CH_3CH_2OH]$ and methanol $[CH_3OH]$. This British patent also suggests the incorporation of more than one compound but does not suggest any specific double compounds.

Seley U.S. Pat. No. 2,411,759, issued Nov. 26, 1946, does suggest the use of double additives, namely, ethyl oxide [diethyl ether or ethyl ether $(C_2H_5)_2O$] and benzine [benzene $C_6H_6$]. White U.S. Pat. No. 2,951,750, issued Sep. 6, 1960, refers to the prior double additives for torch gas of dimethyl ether [methyl ether $(CH_3)_2O$] and benzine [benzene $C_6H_6$] at column 1, lines 21 to 25, presumably as disclosed in the Seley patent, and then proposes the use of the double additive of propylene oxide [1,2-epoxy propane $C_3H_6O$] and dimethyl ether $[(CH_3)_2O]$ at column 1, lines 55 to 62, instead of using benzine and dimethyl ether.

In addition, Kessler U.S. Pat. No. 3,591,355, issued Jul. 6, 1971, proposed the addition of methanol $[CH_3OH]$ to a gas containing propane or a double additive to torch gas, composed of a liquid alkanol such as methanol and a mixture of alkanes such as pentane and isopentane. White U.S. Pat. No. 3,989,479, issued Nov. 2, 1976, also proposed the addition of methanol and British patent specification No. 569,108, accepted May 4, 1945, proposed the addition of ammonia. This British patent also recommended increasing the amount of propane in producer gas, water gas, Mond gas and other commercially available gas mixtures in which methane predominated.

Medsker U.S. Pat. No. 2,908,599, issued Oct. 13, 1959, stated that methyl borate and acetone had been used previously in a fuel for torch use citing U.S. Pat. No. 2,281,910. The Medsker patent proposed a mixture of methyl borate and hexane as an additive for a gaseous fuel. The Bialosky et al. U.S. Pat. No. 2,281,910, issued May 5, 1942, disclosed a liquid flux containing methyl borate and a ketone, such as acetone $[CH_3COCH_3]$ or methyl ethyl ketone [1,2-butanone $CH_3CH_2COCH_3$], to be subjected to a stream of acetylene, hydrogen or similar combustible gas for coating the work with boric acid or oxide.

German Offenlegungsschrift No. 24 55 727, published May 28, 1975, proposes a multitude of additions for fortifying hydrocarbons including higher mono-, di- and polyalcohols having 5 to 20 carbon atoms in each molecule. It is stated at page 12, line 24 that:

> The preferred alcohols are the mono-, di- and polyalcohols of the $C_5$ to $C_8$ hydrocarbons which . . . contain pentanols, hexanols, heptanols, octanols, pentenols, hexenols, heptenols and octenols.

Belgian patent No. PV 35 394 is referred to in Patent of Addition No. BE-A-697,274 which is believed to be Belgian patent No. 689,179, issued Jan. 13, 1967. This patent discloses a method and device for obtaining a fuel mixture of homogeneous composition by spraying into a gaseous aliphatic hydrocarbon fuel such as propane alone or mixed with propylene a conditioning liquid composed of five classes of ingredients, namely:

(a) a component of fuel in liquid form which is the same as the base fuel (b) a combustion activator which can be ethyl ether or a halogeno-ether, particularly a chloroether;

(c) a high calorific value liquid hydrocarbon for enhancing the evaporation of the activator and which is soluble in the activator, such as 2-methyl-butane having the formula $CH_3CH_2CH(CH_3)_2$ in an amount approximately equal to the amount of activator, i.e., between 1% and 12%, and preferably between 5% and 10% of the weight of the fuel used;

(d) a liquid oxidation catalyst, preferably selected from among the constituents of pyridine bases, particularly the alkylpyridines where the alkyl groups are of low molecular weight in an amount between 0.1% and 1% of the weight of fuel; and (e) a hydrotrope which can be a terpenic hydrocarbon, preferably being mixed with a phenylcarbinol or a carbinol alkyl ether, as well as with an aliphatic ester of carboxylic aromatic acid, preferably methyl salicylate.

This five-component conditioning liquid mixture is sprayed into the gaseous fuel at the moment that it is used, so that there will be no preferential vaporization of any of the constituents of the conditioning liquid.

Belgian patent of addition No. BE-A-697,274, issued Jun. 30, 1967 which constitutes an addition to the principal patent No. PV 35 394, discloses the use of an alternative type of combustion activator in the five-component conditioning liquid of the main patent which is sprayed into the gaseous fuel.

Instead of using ethyl ether or a halogeno-ether as disclosed by the main patent for the activator component, the patent of addition uses as a combustion activator a hydrocarbon-oxygenated derivative, particularly an aliphatic hydrocarbon belonging to the group of esters, ketones and olefin oxides having the general formula $C_nH_mO_p$ where n is an integer between 2 and 6, m is an integer between 2n−2 and 2n+2, and p is equal to 1 or 2. The specific activators disclosed are:

acetone ($C_3H_6O$)
ether methyl ketone ($C_4H_8O$)
mesityl oxide (4-methyl-3-penten-2-one) $(CH_3)_2C{=}CHCOCH_3$ ($C_6H_{10}O$)
ethyl acetate ($C_4H_8O_2$)
ethylene oxide ($C_2H_4O$)
propylene oxide ($C_3H_6O$)
butylene oxide (1,2-epoxybutane) ($C_4H_8O$)

The principal torch gas used heretofore has been acetylene which is comparatively expensive, difficult to store and to transport, requires the use of almost pure oxygen with it and forms persistently adherent scoria when used for cutting ferrous metal.

Internal-combustion engine fuels, such as gasoline, have been inclined to detonate in reciprocating piston internal-combustion engines, and it has been found that high-octane gasoline can reduce or eliminate detonation-causing combustion knock and increase power. Another expedient used to deter detonation has been the addition of antiknock material, particularly tetraethyl lead. Also, aromatic amines have been used in amounts averaging 2.6 g. of metal per gallon. Such amines are not commercially used, however, because of their higher cost than tetraethyl lead or mixed methyl ethyl lead alkyls. Also, methylcyclopentadienyl manganese tricarbonyl has been used. In addition, use of other metallic antiknock compounds have been proposed, such as thallium, selenium and tellurium organic compounds, but these have not proven to be useful.

A disadvantage of using tetraethyl lead is that the lead has been discharged into the air, and lead is physically harmful, so that its use in gasoline for internal-combustion engines has been phased out. Methyl tertiary butyl ether (MTBE) or methyl tert-butyl ether [tert-butyl methyl ether] $(CH_3)_3COCH_3$ by itself has been used as an additive for unleaded gasoline as an octane booster and to reduce harmful emission products.

Also, methyl ethyl ketone (MEK) has been used by itself heretofore as an additive for torch gas.

SUMMARY OF THE INVENTION

A principal object of this invention is to provide a simple additive for fortifying hydrocarbon such as torch gas so as to have characteristics superior to those of acetylene, especially for cutting ferrous metal, and also for welding. Such object also includes providing fortified hydrocarbon having characteristics superior to those of hydrocarbon fortified only by the addition of methyl ethyl ketone.

A particular object is to provide a torch gas which will have high flame temperature and intense heating capability.

A further object is to provide torch gas that can be stored and transported easily and economically.

Another object is to provide a torch gas having a base gas which is readily available in almost the entire world, can be provided more economically and is easy to fortify for enhancing its attributes.

It is also an object to provide a torch gas enabling ferrous metal to be cut faster and cleaner.

Another object is to provide a gas that can be used by torches for cutting under water at considerable depths.

An additional object is to provide a gas that can be used for torch cutting more economically because it will combine effectively with oxygen containing a higher proportion of adulterating gases which cannot be used with acetylene.

The foregoing objects can be accomplished by utilizing liquefied petroleum gas fortified with methyl ethyl ketone and methyl tertiary butyl ether or with lower pluraloxyhydrocarbons, namely dioxy- and trioxyhydrocarbons having two to four carbon atoms in each molecule or with a combination of additions from such pluraloxyhydrocarbons and/or selected lower monooxyhydrocarbons having three or four carbon atoms in each molecule.

A further object of this invention is to provide fortified hydrocarbon for purposes other than torch gas, such as high-temperature heating gas or oil for heating industrial furnaces such as for melting metals for pouring, and blast furnaces.

This further object can be accomplished by utilizing liquid petroleum gas, natural gas or liquid hydrocarbon, such as diesel oil or fuel oil fortified with additives specified above.

A still further object is to fortify liquid hydrocarbon, especially gasoline, for use as an internal-combustion engine fuel to deter detonation and promote uniformity of combustion.

This still further object can be accomplished by adding to the gasoline ethylene glycol monomethyl ether $CH_3OCH_2CH_2OH$ [$C_4H_{10}O_2$] or ethyl acetate $CH_3COOC_2H_5$ [$C_4H_8O_2$] as an additive.

DETAILED DESCRIPTION

Liquefied petroleum gas (LPG) is the preferred base gas for the fortified torch gas of the present invention because of its high butane and propane content. Both the n-butane and isobutane isomers of butane are usually present in LPG, but a substantial amount of butane may have been removed from LPG sold as fuel because of the demand from industry for butane derivatives, in which case the LPG is composed largely of propane. It is, however, desirable that there be a reasonable proportion of butane in the LPG, such as from 5% to 40%.

Alternatively, the base gas could be propane or butane alone or any mixture of these gases or propylene or other gaseous hydrocarbon.

The addition or conditioner used to fortify the base gas may be simply a combination of methyl ethyl ketone (MEK), otherwise known as 2-butanone, having the formula $CH_3COCH_2CH_3$ and methyl tertiary butyl ether, otherwise known as methyl tert-butyl ether (MTBE) or tert-butyl methyl ether having the formula $(CH_3)_3COCH_3$. MEK is a liquid with a boiling point of 70.6 degrees C. and a specific gravity of 0.805 at 20 degrees C. At ambient temperature MTBE is a colorless liquid having a boiling point of 55 degrees C. and a freezing point of −110 degrees C. and has a specific gravity of 0.74.

LPG must be stored under pressure to keep it in a liquid state, but relatively heavy pressurized storage tanks and handling equipment for LPG is commercially practical and customary.

Without being fortified, LPG mixed with oxygen is not very effective for torch cutting and welding, not nearly as effective as acetylene gas mixed with substantially pure oxygen, but by enriching the base LPG with an effective additive the flame temperature is considerably increased and the heating capability is greatly improved.

The amount of additive used will depend on the extent to which it is desired to improve the characteristics of the base gas, but the amount would be 3% to 10% of the base gas by weight, Where a combination of MEK and MTBE is used, preferably 3% to 5% of MEK and 2% or 3% of MTBE is appropriate as the sole additive.

The procedure for combining the additive with the LPG is simple. The fortifying liquid is simply mixed with the hydrocarbon in liquid form. The additive which is liquid at normal temperatures is supplied to the storage tank in which the LPG under liquefying pressure is to be stored or transported. It is quite practical to supply the additive to standard 55-gallon drums.

If more additive is supplied than about 6% of the base gas by weight, such additive should be supplied in conjunction with a catalyst, preferably activated carbon in the form of powder, granules or pellets to insure homogeneous mixing. The activated carbon is amorphous, preferably having been produced from coal or petroleum coke. Alternative catalysts that can be used are platinum, cupric oxide and granular silver carried by a suitable carrier.

The amount of activated carbon used is not critical, but it should be placed in the bottom of a storage container to facilitate mixing of the additive with the hydrocarbon base gas when it is supplied to the container under pressure. An amount of such catalyst between 1% and 5% of the weight of the additive would be satisfactory. The resulting liquid mixture of base gas and additive or conditioner will be azeotropic at normal temperatures so that the fortified torch gas evaporated from the fortified liquid mixture will be homogeneous when it is released from the storage container to the torch without the addition of other hydrocarbon gas or being supplied to other hydrocarbon gas.

In order to provide an effective cutting flame, it is necessary to supply to an acetylene torch oxygen that is in substantially pure form, such as at least 99% oxygen by volume. Satisfactory cutting temperatures can be provided by mixing with the fortified base gas of the present invention less pure oxygen such as oxygen having a purity of approximately 95%, the adulterant being nitrogen, carbon dioxide and other gas components of air. Even when oxygen having a purity as low as 90% is used, the flame temperature of base LPG of approximately 5,000 degrees F. can be raised to approximately 5,800 degrees F. to 6,000 degrees F. by use of the base LPG fortified by additives according to the present invention. Such impure oxygen can be produced economically by compressing air to about 4,000 psi, chilling it to minus 360 degrees F. which liquefies the air and then allowing the temperature of the liquefied air to rise gradually while venting the container to release the nitrogen component of the liquefied air which vaporizes at minus 320 degrees F. leaving the oxygen in liquid form.

In other processes for producing impure oxygen, nitrogen of the air is removed by zeolite resulting in oxygen of 90% to 95% purity.

An advantage of using the fortified base gas of the present invention over acetylene for cutting ferrous metal is that a clean precise kerf is obtained. Oxyacetylene cutting produces a hard scoria persistently adherent to the work which increases the heating required and usually must subsequently be chipped off the work. Utilization of the fortified torch gas of the present invention produces a soft friable scoria which is sloughed off the work and out of the kerf as the cutting progresses to leave a narrower clean kerf with virgin metal along opposite margins of the kerf.

A particular advantage which the fortified torch gas of the present invention has is that it can be used for flame cutting under water to a depth of 300 feet. The use of the oxyacetylene torch is limited to 20 feet under water because at pressures to which it would be necessary to subject the gas to enable it to be dispensed to the cutting torch at greater depths the acetylene will epoxide. Consequently, the only alternative that has been available for cutting under water at depths greater than about 20 feet prior to use of MEK as an additive to hydrocarbon gas has been the use of a carbon arc, the action of which is slow and the use of which is dangerous.

While the use of MEK has been beneficial in expediting cutting of metal and the use of MEK enhanced by the addition of tert-butyl alcohol (TBA) has increased the cutting speed from 5% to 10%, the use of MEK and MTBE in combination has increased the cutting speed to 20% to 25% faster than where MEK has been used alone as an additive and about 15% faster than the cutting speed where the MEK has been enhanced with TBA.

In addition to use of the present invention in fortified torch gas, the invention can be used for high-temperature hydrocarbon heating gas, such as LPG or natural gas and high-temperature hydrocarbon heating liquids, such as boiler fuel oil, stove oil or other oil used in such industrial processes as smelting or other metal melting such as required for foundry casting, or for steam generating. For such purposes, the additive can be within the range of 2% to 10% of the hydrocarbon by weight. If the amount of additive is greater than about 5%, a catalyst such as powdered activated carbon should be used to facilitate thorough mixing of the additive with the hydrocarbon.

Use of hydrocarbon gas such as LPG for soldering, brazing or light metal cutting is rendered more effective if the additive of the present invention is mixed with the gas. For such use it is preferable to use less additive than in the case of torch gas for cutting or welding thick metal. For soldering, brazing or light cutting, an amount of additive within the range of 2% to 5% by weight is adequate, and such an amount can be mixed sufficiently intimately with the hydrocarbon gas without the use of a catalyst.

As alternatives to the use of a combination of MEK and MTBE described above the additive of the present invention may be simply a single lower pluraloxyhydrocarbon, namely, a dioxy or trioxyhydrocarbon having from 2 to 4 carbon atoms in the molecule and which may be an alcohol, an ether or an acetate. Particular examples of such pluraloxyhydrocarbons are specified in the tables below:

| Name | Formula | Formula Weight |
|---|---|---|
| Dihydric Alcohols (Diols) | | |
| 1,2-ethanediol | $C_2H_6O_2$ | Formula Weight 62 |
| $HOCH_2CH_2OH$, also called ethylene glycol | | |
| 1,2-propanediol | $C_3H_8O_2$ | Formula Weight 76 |
| $CH_3CH(OH)CH_2OH$, also called propylene glycol | | |
| 1,3 butanediol | $C_4H_{10}O_2$ | Formula Weight 90 |
| $CH_3CH(OH)CH_2CH_2OH$, also called 1,3 butylene glycol | | |
| Trihydric Alcohols | | |
| glycerol | $C_3H_8O_3$ | Formula Weight 92 |

-continued

| Name | Formula | Formula Weight |
|---|---|---|
| $HOCH_2CH(OH)CH_2OH$ | | |
| diethylene glycol | $C_4H_{10}O_3$ | Formula Weight 106 |
| $HOCH_2CH_2OCH_2CH_2OH$, also called bis (2-hydroxyethyl) ether | | |
| Dioxyethers | | |
| ethylene glycol monomethyl ether | $C_3H_8O_2$ | Formula Weight 76 |
| $CH_3OCH_2CH_2OH$, also called 2-methoxyethanol | | |
| ethylene glycol monoethyl ether | $C_4H_{10}O_2$ | Formula Weight 90 |
| $CH_3CH_2OCH_2CH_2OH$, also called 2-ethoxyethanol | | |
| ethylene glycol dimethyl ether | $C_4H_{10}O_2$ | Formula Weight 90 |
| $CH_3OCH_2CH_2OCH_3$, also called 1,2 dimethoxyethane | | |
| Acetates | | |
| ethyl acetate | $C_4H_8O_2$ | Formula Weight 88 |
| $CH_3COOC_2H_5$, also called acetic ester or acetic ether | | |

The effect of various monooxyhydrocarbons to enhance the combustion of torch gases when used alone is varied and unpredictable. The following lower monooxyhydrocarbons are reasonably beneficial in combination as enhancing additives without the use of other additive components. Such monooxyhydrocarbons will have three or four carbon atoms in a molecule.

| | | |
|---|---|---|
| Monohydric Alcohols | | |
| n-propyl alcohol | $C_3H_8O$ | Formula Weight 60 |
| $CH_3CH_2CH_2OH$, also called 1-propanol | | |
| isopropyl alcohol | $C_3H_8O$ | Formula Weight 60 |
| $(CH_3)_2CHOH$, also called 2-propanol | | |
| n-butyl alcohol | $C_4H_{10}O$ | Formula Weight 74 |
| $CH_3CH_2CH_2CH_2OH$, also called 1-butanol | | |
| isobutyl alcohol | $C_4H_{10}O$ | Formula Weight 74 |
| $(CH_3)_2CHCH_2OH$, also called 2-methyl-1-propanol | | |
| sec butyl alcohol | $C_4H_{10}O$ | Formula Weight 74 |
| $CH_3CH_2CH(OH)CH_3$, also called 2-butanol | | |
| Ketones | | |
| methyl ethyl ketone | $C_4H_8O$ | Formula Weight 72 |
| $CH_3COCH_2CH_3$, also called 2-butanone | | |
| Aldehydes | | |
| propionaldehyde | $C_3H_6O$ | Formula Weight 58 |
| $CH_3CH_2CHO$, also called 1-propanal | | |
| butyraldehyde | $C_4H_8O$ | Formula Weight 72 |
| $CH_3CH_2CH_2CHO$ | | |

While the monooxyhydrocarbons listed above do not individually enhance LPG, butane or propane gas sufficiently to be comparable to acetylene for use in cutting or welding, the combination of two or three additives selected from the monooxyhydrocarbons specified above and the dioxyhydrocarbons and trioxyhydrocarbons will provide greater enhancement than any one of such chemicals alone.

Also, while it is practical to utilize a single pluraloxyhydrocarbon as an additive, better results are obtained by combining pluraloxyhydrocarbons with each other or with a monooxyhydrocarbon of a suitable type without using other components in the additive.

For example, while LPG enhanced with 3% by weight of the base gas of either 1,2 ethanediol or ethylene glycol monomethyl ether will enable a perfect cut of steel to be made as rapidly as by the use of acetylene, a cutting operation in which the base gas is enhanced with 3% by weight of each of such additives will enable an excellent cut to be made at a rate faster than could be obtained using acetylene.

Also, as good and almost as fast a cut can be obtained by using as an additive 3% by weight of the base gas of 1,2-ethanediol and 2% by weight of the base gas of methyl ethyl ketone. Comparable results can be obtained by using 3% by weight of the base gas of ethylene glycol monomethyl ether and n-propyl alcohol.

While mention has been made of using 2% or 3% of each of two oxyhydrocarbons specified above in combination, it is also possible to obtain good enhancement by using a combination of 2% by weight of the base gas of each of three of the oxyhydrocarbons specified above.

Another use of additive is for fortifying internal-combustion engine fuel, such as automotive gasoline, aviation gasoline or diesel oil. For such use the additive functions as an antiknock agent as well as improving the uniformity of combustion and accelerating the rate of combustion, which consequently enhances the power-producing characteristics of the fuel. Ethylene glycol monomethyl ether and ethyl acetate are beneficial for this purpose.

For internal-combustion engine fuel use, the range of additive used would be 0.5% to 6% of the hydrocarbon by weight but preferably within the range of 1% to 4% by weight.

I claim:

1. Fortified hydrocarbon torch gas which is mixture of a major portion by weight of hydrocarbon base gas and additive consisting essentially of a minor portion by weight of additive selected from the group consisting of dioxyhydrocarbons and trioxyhydrocarbons having 2 to 4 carbon atoms in a molecule.

2. The torch gas defined in claim 1, in which the amount of additive is within the range of 0.5% to 13% of the hydrocarbon base gas by weight.

3. The torch gas defined in claim 1, in which the amount of additive is within the range of 3% to 7% of the hydrocarbon base gas by weight.

4. The torch gas defined in claim 1, in which the additive is only one dioxyhydrocarbon or trioxyhydrocarbon.

5. The torch gas defined in claim 4, in which the additive is selected from the group consisting of 1,2-ethanediol, 1,2-propanediol, 1,3 butanediol, glycerol, diethylene glycol, ethylene glycol monomethyl ether, ethylene glycol monoethyl ether, ethylene glycol dimethyl ether and ethyl acetate.

6. The torch gas defined in claim 1, in which the base gas is LPG (liquid petroleum gas).

7. The torch gas defined in claim 1, in which the hydrocarbon base gas is natural gas.

8. Fortified hydrocarbon torch gas which is a mixture of a major portion by weight of hydrocarbon base gas and a minor portion by weight of additive which additive consists essentially of two or more components selected from the group consisting of 1,2-ethanediol, 1,2-propanediol, 1,3 butanediol, glycerol, diethylene glycol, ethylene glycol monomethyl ether, ethylene glycol monoethyl ether, ethylene glycol dimethyl ether, ethyl acetate, n-propyl alcohol, isopropyl alcohol, n-butyl alcohol, isobutyl alcohol, sec butyl alcohol, methyl ethyl ketone, propionaldehyde, and butyraldehyde.

9. Fortified hydrocarbon torch gas which is an azeotropic mixture of a major portion by weight of hydrocarbon base gas and a minor portion by weight of additive selected from the group consisting of 1,2-ethanediol, 1,2-propanediol, 1,3 butanediol, glycerol, diethylene glycol, ethylene glycol monomethyl ether, ethylene glycol monoethyl ether, ethylene glycol dimethyl ether and ethyl acetate.

10. Fortified hydrocarbon torch gas which is an azeotropic mixture of a major portion by weight of hydrocarbon base gas maintained in liquid form under pressure and a minor portion by weight of fortifying liquid additive selected from the group consisting of 1,2-ethanediol, 1,2-propanediol, 1,3 butanediol, glycerol, diethylene glycol, ethylene glycol monomethyl ether, ethylene glycol monoethyl ether, ethylene glycol dimethyl ether and ethyl acetate.

11. The process of making fortified hydrocarbon for use as torch gas by supplying to hydrocarbon base gas maintained in liquid form under pressure additive consisting essentially of additive selected from the group consisting of dioxyhydrocarbons and trioxyhydrocarbons having 2 to 4 carbon atoms in a molecule, which additive is supplied to the hydrocarbon base as the only additive.

12. The process defined in claim 11, including supplying LPG as the hydrocarbon base gas.

13. The process defined in claim 12, including supplying additive within the range of 0.5% to 13% of the hydrocarbon base gas by weight.

14. The process of making fortified hydrocarbon for use as torch gas by supplying to hydrocarbon base gas maintained in liquid form under pressure additive consisting essentially of two or more chemicals selected from the group consisting of 1,2-ethanediol, 1,2-propanediol, 1,3 butanediol, glycerol, diethylene glycol, ethylene glycol monomethyl ether, ethylene glycol monoethyl ether, ethylene glycol dimethyl ether, ethyl acetate, n-propyl alcohol, isopropyl alcohol, n-butyl alcohol, isobutyl alcohol, sec butyl alcohol, methyl ethyl ketone, propionaldehyde, and butyraldehyde as the only additive.

15. The process of torch cutting ferrous metal which comprises supplying to hydrocarbon base gas maintained in liquid form under pressure fortifying liquid additive selected from the group consisting of 1,2-ethanediol, 1,2-propanediol, 1,3 butanediol, glycerol, diethylene glycol, ethylene glycol monomethyl ether, ethylene glycol monoethyl ether, ethylene glycol dimethyl ether and ethyl acetate to form an azeotropic liquid mixture, vaporizing such azeotropic fortified torch gas liquid mixture, and supplying a gas mixture vaporized from such fortified torch gas liquid mixture and oxygen to a torch.

16. Fortified hydrocarbon torch gas which is a mixture of a major portion by weight of hydrocarbon base gas and additive consisting essentially of a minor portion by weight of dioxyether having not more than 4 carbon atoms in a molecule.

17. The torch gas defined in claim 16, in which the base gas is LPG (liquid petroleum gas).

18. The torch gas defined in claim 16, in which the hydrocarbon base gas is natural gas.

19. Fortified hydrocarbon torch gas which is a mixture of a major portion by weight of hydrocarbon base gas and additive consisting essentially of a minor portion by weight of additive selected from the group consisting of ethylene glycol monomethyl ether, ethylene glycol monoethyl ether, ethylene glycol dimethyl ether and ethyl acetate.

20. Fortified hydrocarbon torch gas which is a mixture of a major portion by weight of hydrocarbon base gas and a minor portion by weight of additive which additive consists essentially of at least one alcohol component selected from the group consisting of 1,2-ethanediol, 1,2-propanediol, 1,3 butanediol, glycerol, diethylene glycol, n-propyl alcohol, isopropyl alcohol, n-butyl alcohol, isobutyl alcohol and sec butyl alcohol, and at least a second component selected from the group consisting of ethylene glycol monomethyl ether, ethylene glycol monoethyl ether, ethylene glycol dimethyl ether, ethyl acetate, tert butyl methyl ether, methyl ethyl ketone, propionaldehyde, and butyraldehyde.

21. Fortified hydrocarbon torch gas which is an azeotropic mixture of a major portion by weight of hydrocarbon base gas maintained in liquid form under pressure and a minor portion by weight of fortifying liquid additive selected from the group consisting of ethylene glycol monomethyl ether, ethylene glycol monoethyl ether, ethylene glycol dimethyl ether and ethyl acetate.

22. The process of torch cutting ferrous metal which comprises supplying to hydrocarbon base gas maintained in liquid form under pressure fortifying additive selected from the group consisting of ethylene glycol monomethyl ether, ethylene glycol monoethyl ether, ethylene glycol dimethyl ether and ethyl acetate to form an azeotropic liquid mixture, vaporizing such azeotropic fortified torch gas liquid mixture, and supplying a gas mixture vaporized from such fortified torch gas liquid mixture and oxygen to a torch.

* * * * *